US005951442A

United States Patent [19]

Adams et al.

[11] Patent Number: 5,951,442

[45] Date of Patent: Sep. 14, 1999

[54] TANDEM EXERCISE DEVICE FOR A MOBILITY-IMPAIRED PERSON

[76] Inventors: Richard D. Adams, R.D. #1, Box 46, Columbus, Pa. 16405; Carl Thorson, R.D. #2, Corry, Pa. 16407

[21] Appl. No.: 08/864,143

[22] Filed: May 28, 1997

Related U.S. Application Data

[60] Provisional application No. 60/018,443, May 28, 1996.

[51] Int. Cl.[6] ..... A63B 21/00

[52] U.S. Cl. ..... 482/57

[58] Field of Search ..... 482/51, 57, 62, 482/906; 472/21, 27, 89

[56] References Cited

U.S. PATENT DOCUMENTS

| | | | |
|---|---|---|---|
| 2,641,249 | 6/1953 | Brockman | 482/57 |
| 4,402,502 | 9/1983 | Peters | 482/62 |
| 4,768,777 | 9/1988 | Yang | 482/57 |
| 4,824,132 | 4/1989 | Moore | 280/304.1 |
| 4,919,416 | 4/1990 | DeCloux | 482/57 |
| 5,284,131 | 2/1994 | Gray | 128/25 |
| 5,299,992 | 4/1994 | Wilkinson | 482/57 |
| 5,501,476 | 3/1996 | Howell et al. | 482/57 |
| 5,595,557 | 1/1997 | Lambert, Sr. et al. | 482/57 |
| 5,647,822 | 7/1997 | Avganim | 482/57 |

*Primary Examiner*—Stephen R. Crow

*Attorney, Agent, or Firm*—Webb Ziesenheim Logsdon Orkin & Hanson, P.C.

[57] ABSTRACT

An exercise device and method is provided for exercising the legs of a mobility-impaired person. The device includes a base with a crank assembly carried on the base. The crank assembly includes a first sprocket assembly having a pair of foot pedals and a second sprocket assembly having at least one leg-support assembly. The leg-support assembly is adapted to support a leg of the mobility-impaired person. The first sprocket assembly is connected to the second sprocket assembly such that rotation of the first sprocket assembly causes rotation of the second sprocket assembly whereby the leg of the mobility-impaired person attached to the at least one leg-support assembly is exercised.

19 Claims, 3 Drawing Sheets

TANDEM EXERCISE DEVICE FOR A MOBILITY-IMPAIRED PERSON

CROSS REFERENCE TO RELATED APPLICATION

This application claims the benefit of Provisional Application Ser. No. 60/018,443, filed on May 28, 1996 and entitled "Exercise Equipment for the Handicapped".

BACKGROUND OF THE INVENTION

1. Field of the Invention

The invention relates generally to the field of exercise equipment and, more particularly, to an exercise device in which rotary movement of the pedals of one sprocket assembly by an operator causes rotary movement of a second sprocket assembly to which a mobility-impaired person's legs are attached, thus exercising the mobility-impaired person's legs.

2. Description of the Prior Art

The importance of exercise in promoting both the physical and mental health of individuals is well known in the medical community. Exercise is of particular importance to those individuals who have suffered partial or total paralysis as a result of, for example, spinal injury, stroke, arthritis, chronic back pain, multiple sclerosis, muscular dystrophy and the like and are confined to a wheelchair. Such individuals need to exercise their unused or under used muscles or limbs to prevent problems such as poor circulation, stiff joints and tendons, swelling in the lower limbs and general muscle atrophy, which can lead to generalized limb pain as well as general deterioration of the cardiovascular system and increased susceptibility to blood clots. Even for totally paralyzed individuals, passive limb exercise is extremely helpful to counteract the effects of long-term immobilization. Exercise tends to make joints more flexible, helps prevent atrophy of muscles and tendons, increases circulation, enables the heart to work more efficiently and gives rise to a general feeling of health and well being.

Exercise devices have been developed to provide therapeutic treatment to injured or mobility-impaired individuals. One such device is disclosed in U.S. Pat. No. 5,284,131 to Gray. The Gray patent discloses a having a foot plate and strap assembly attached to a motor-driven pedal system. A user's feet are secured to a pair of foot plates attached to crank arms, and an electric motor is used to drive the crank arms, thus applying rotary motion to the user's legs. A remote control device is used to control the speed of the motor. However, such motorized devices have certain disadvantages. For example, motorized devices can only be used where there is a source of electrical power. Additionally, such motorized devices are generally expensive to purchase and maintain. Further, the unsupervised use of such motorized devices could prove dangerous or otherwise harmful for wheelchair-bound users who require close attention or special regulated speeds. Such motor-driven units are also somewhat noisy during use.

U.S. Pat. No. 4,824,132 to Moore discloses a non-motorized exercise device which can be attached to a wheelchair. The Moore device has an upright stand having a wheel mounted on the bottom of the stand and a hand crank assembly mounted at the top of the stand. Movement of pedals attached to the wheel provides rotary motion to the wheel, which can be used to propel the wheelchair. The hand crank assembly can be used in conjunction with the pedals.

A problem with known exercise devices for the mobility-impaired is that, in many such devices, the user exercises alone. While a monitor or therapist may be present, the user is usually the only one who is undergoing any physical activity. As anyone who has ever tried to maintain an individual exercise program is aware, such an individualized exercise regime is difficult to sustain in the long run. One misses the companionship and comradery associated with exercising along with another person. Additionally, there is little incentive to push the exercise beyond the minimum amount required. Such individualized exercise programs, therefore, often fail.

Therefore, it is an object of the invention to provide an exercise device for a mobility-impaired person in which the loneliness associated with solitary exercise devices is eliminated. It is a further object of the invention to provide an exercise device in which a companion, such as a physical therapist, can exercise along with the mobility-impaired person to provide visual and voice contact during the exercise routine. It is also an object of the invention to provide a tandem exercise device in which an operator, pedaling the pedals of one sprocket assembly, has direct and immediate control over the speed of rotation of a second sprocket assembly to which the legs of a mobility-impaired person are attached.

SUMMARY OF THE INVENTION

An exercise device is provided for exercising the legs of a mobility-impaired person. The device includes a base with a crank assembly carried on the base. The crank assembly includes a first sprocket assembly having a pair of foot pedals and a second sprocket assembly having at least one leg-support assembly. The leg-support assembly is adapted to support a leg of the mobility-impaired person. The first sprocket assembly is connected to the second sprocket assembly such that rotation of the first sprocket assembly causes rotation of the second sprocket assembly whereby the leg of the mobility-impaired person attached to the at least one leg-support assembly is exercised.

A method is provided for exercising the legs of a mobility-impaired person by rotating a first sprocket assembly connected to a second sprocket assembly. At least one of the mobility-impaired person's legs is attached to a leg-support assembly rotatably carried on the second sprocket assembly. The first sprocket assembly is pedaled to cause rotation of the second sprocket assembly whereby the leg of the mobility-impaired person attached to the leg-support assembly is exercised.

A complete understanding of the invention will be obtained from the following description when taken in connection with the accompanying drawing figures wherein like reference characters identify like parts throughout.

DESCRIPTION OF THE PREFERRED EMBODIMENTS

Figure 1:
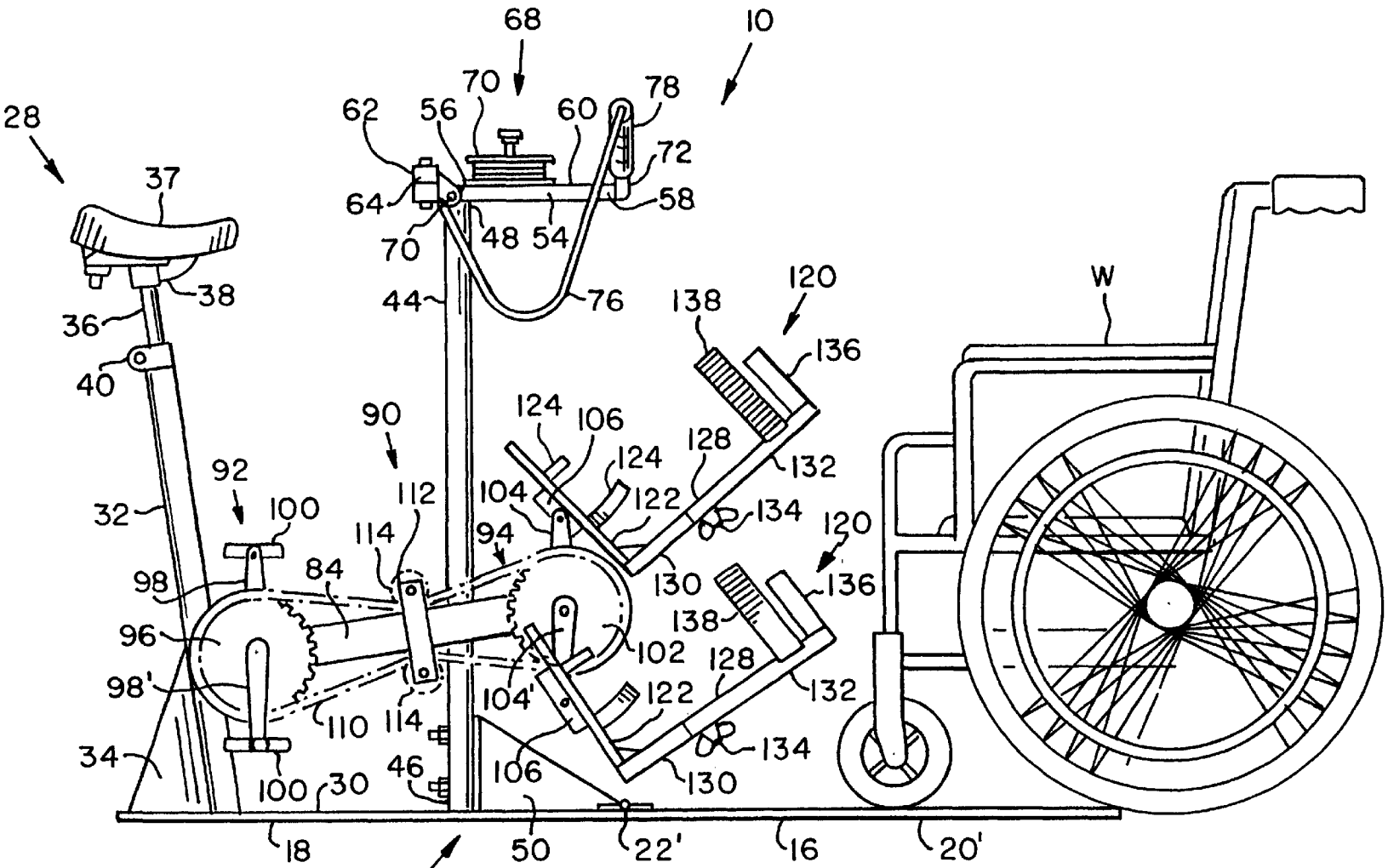
FIG. 1 is a side elevation of an exercise device of the invention in combination with a wheelchair.

For purposes of the description hereinafter, the terms "upper", "lower", "right", "left", "vertical", "horizontal", "top", "bottom" and derivatives thereof shall relate to the invention as it is oriented in the drawing figures. However, it is to be understood that the invention may assume various alternative variations and step sequences, except where expressly specified to the contrary. It is also to be understood that the specific devices and processes illustrated in the attached drawings, and described in the following specification, are simply exemplary embodiments of the invention. Hence, specific dimensions and other physical characteristics related to the embodiments disclosed herein are not to be considered as limiting.

Figure 2:
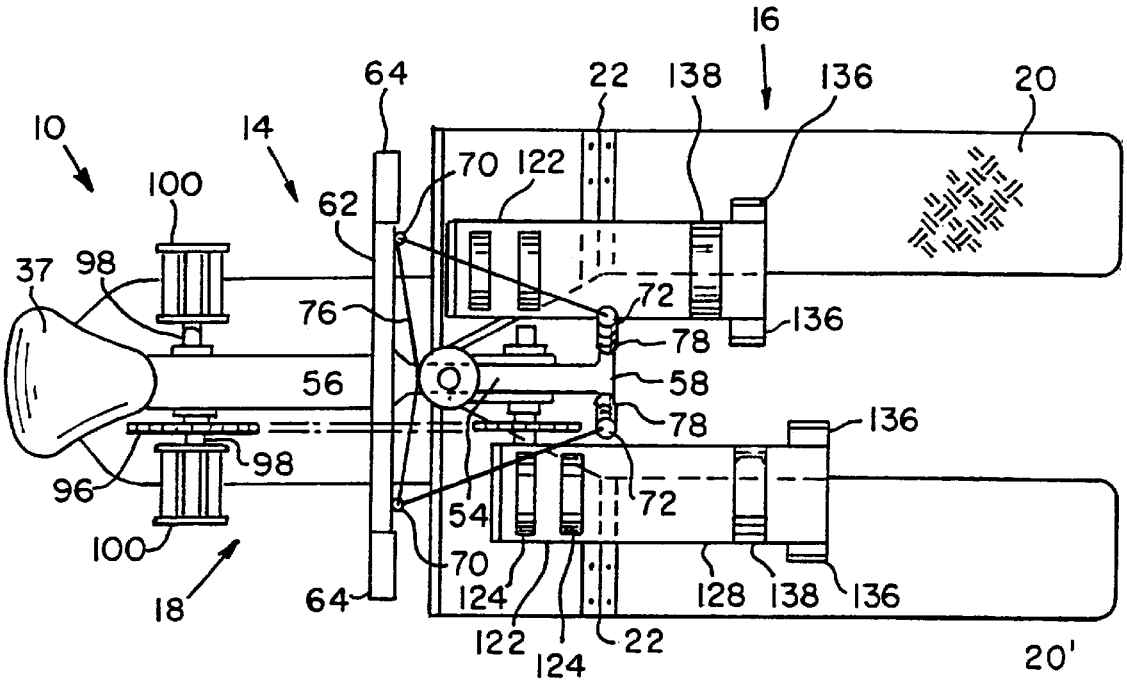
FIG. 2 is a plan view of the exercise device of FIG. 1.

A first embodiment of the tandem exercise device of the invention is generally designated 10 in FIGS. 1 and 2 of the drawings. As shown particularly in FIG. 3 of the drawings, the exercise device 10 includes a framework 12 mounted on a base 14. As shown particularly in FIG. 2 of the drawings, the base 14 has a first base portion 16 and a second base portion 18. The first base portion 16 includes a pair of spaced-apart wheelchair support plates 20, 20' pivotally mounted to the base 14 by hinges 22, 22'. The base 14 is preferably made of metal, such as aluminum, and the upper surfaces of the wheelchair support plates 20, 20' preferably include a raised, slip-preventing pattern.

As shown in FIG. 1 of the drawings, a seat assembly 28 is mounted on an upper surface 30 of the base 14. The seat assembly 28 includes a seat post or first post 32 attached to the upper surface 30 of the base 14 in a conventional manner, such as welding or bolting. A support rib or gusset 34 extends between the upper surface 30 of the base 14 and the first post 32. A shaft 36 is slidably, for example telescopically, carried in the first post 32. A seat 37, such as a conventional bicycle seat, is attached to an outer end 38 of the shaft 36. The position of the shaft 36 in the first post 32 is fixed by a height adjustment device 40, such as a conventional adjustment collar and bolt assembly used on conventional bicycles. The first post 32 preferably extends at an angle from the base 14.

A second post 44 is mounted on, and extends substantially perpendicularly from, the upper surface 30 of the base 14. The second post is spaced from the first post 32 and has a first end 46 mounted on the base 14 and a second end 48 spaced from the base 14. The second post 44 is attached to the base 14 in a conventional manner, such as by welding, and may be supported by gussets 50. As shown in FIGS. 1 and 2 of the drawings, a shelf member 54 is attached to the second end 48 of the second post 44. The shelf member 54 has a first end 56, a second end 58 and a top surface 60. A handlebar 62 is attached near the first end 56 of the shelf member 54 and extends substantially perpendicularly to a longitudinal axis of the second post 44. Handgrips 64 are mounted on the ends of the handlebar 62.

An upper torso exercise device 68 is carried on the second post 44. The upper torso exercise device 68 includes a pair of spaced-apart pulleys 70 mounted on the handlebar 62. A pair of holding elements 72, in the form of cylindrical rods, are mounted on the shelf member 54 near the second end 58. The holding elements 58 preferably extend at an angle from the shelf member 54. A tension spool 74 is rotatably carried on the top surface 60 of the shelf member 54 between the handlebar 62 and the holding elements 72. A rope 76 is carried on the tension spool 74 and terminates in a pair of handles 78. The rope 76 is threaded through the pulleys 70 attached to the handlebar 62. A spring-biased tension adjustment handle 80 is mounted on the tension spool 74. This type of rope pull device is well known in exercise devices as found, for example, in a conventional Nordic-Trak® device.

Figure 3:
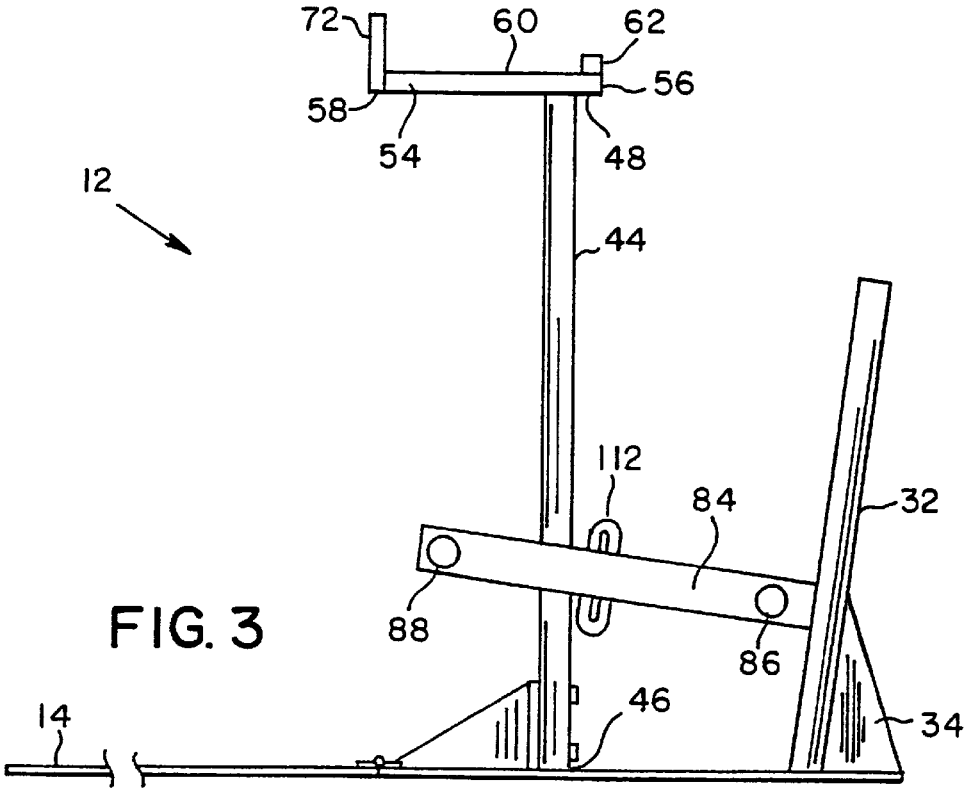
FIG. 3 is a side elevation of a structural framework of the exercise device of the invention.

As shown particularly in FIGS. 1 and 3, a cross member 84 is connected to the first post 32 and the second post 44 and extends substantially perpendicularly to a longitudinal axis of the first post 32. The cross member 84 is substantially rectangular and includes a first bearing hole 86 and a second bearing hole 88. A crank assembly 90 is mounted on the cross member 84. The crank assembly 90 includes a first sprocket assembly 92 rotatably carried in the first bearing hole 86 and a second sprocket assembly 94 rotatably carried in the second bearing hole 88. The first sprocket assembly 92 includes a rotatable first sprocket 96 having a pair of first crank arms 98, 98'. A pedal 100, such as a conventional bicycle pedal, is rotatably mounted on the end of each first crank arm 98, 98'. The second sprocket assembly 94 includes a rotatable second sprocket 102 having a pair of second crank arms 104, 104'. A pedal 106 is mounted on the end of each second crank arm 104. The sprocket assemblies 92, 94 are of conventional type, such as those found on a conventional bicycle. A chain 110 engages the sprocket teeth of the sprockets 96, 102 such that rotation of one of the sprockets 96, 102 also causes the other sprocket 96, 102 to rotate. A tensioning device 112 is mounted on the cross member 84. The tensioning device 112 includes a pair of rotatable members 114 which are adjustable in a transverse direction relative to the chain 110 so that a tensioning force on the chain 110 can be selectively maintained and the chain 110 can be securely held on the sprockets 96, 102.

A leg-support assembly 120 is attached to each pedal 106 of the second sprocket assembly 94. Each leg-support assembly 120 includes a substantially planar foot plate 122 having a pair of spaced-apart flexible foot-holding straps 124. The foot-holding straps 124 preferably include conventional Velcro® fasteners. The foot plates 122 are attached to the pedals 106 of the second sprocket assembly 94 in a conventional manner, such as by bolts or holding straps. A calf-supporting section 128 is attached to, and extends substantially perpendicularly from, each foot plate 122. The calf-supporting section 128 includes a first segment 130 and a second segment 132. The second segment 132 is slidable with respect to the first segment 130 so that the length of the calf-supporting section 128 is selectively adjustable. A locking assembly 134, such as a conventional wing nut assembly, is mounted on the calf-supporting section 128 to lock the first segment 130 and second segment 132 relative to each other. The calf-supporting section 128 further includes a pair of opposed, curved calf-supporting arms 136 attached near the outer end of the calf-supporting section 128. A calf-holding strap 138 is carried on the calf-supporting section 128 and preferably includes Velcro® fasteners.

Figure 4:
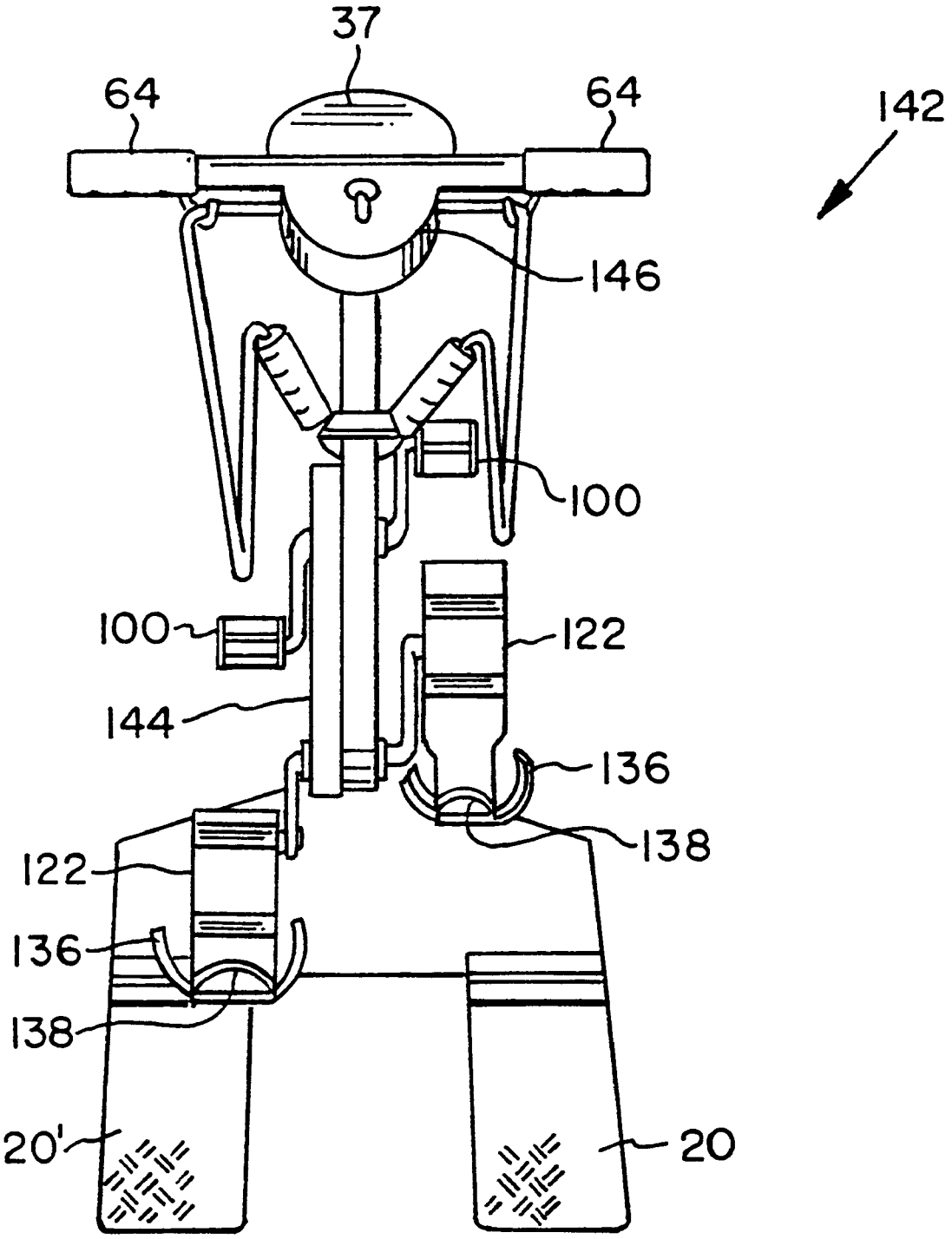
FIG. 4 is a front view of an alternative embodiment of the exercise device of the invention.

A second embodiment of the exercise device is generally designated 142 in FIG. 4 of the drawings. The exercise device 142 shown in FIG. 4 of the drawings is similar to the device 10 shown in FIGS. 1–3 of the drawings, but includes a sprocket and chain cover 144 enclosing the sprockets 96, 102 and chain 110. The exercise device 142 also includes a spool cover 146 enclosing the tension spool 74 of the upper torso exercise device 68.

Operation of the exercise device 10 will now be discussed.

To utilize the exercise device 10, a patient or mobility-impaired person, preferably in a wheelchair W, is positioned in front of the second sprocket assembly 94 as shown in FIG. 1 of the drawings. The wheelchair W is wheeled into position such that at least the front wheels of the wheelchair rest on the upper surface of the support plates 20, 20' of the base 14. Each of the patient's lower legs is secured to the leg-support assemblies 120 in the following manner. The bottom of the patient's foot is placed against the foot plate 122 and secured by the foot-holding straps 124. In this position, the patient's calf rests against the inner side of the calf-supporting section 128, with the calf-supporting arms 136 partially encircling the patient's upper calf. The position of the calf-supporting arms 136 is adjustable by unlocking the locking assembly 134 and sliding the second segment 132 of the calf-supporting section 128 with respect to the first segment 130 to move the calf-supporting arms 136 to a comfortable position for the patient. The locking assembly 134 is then reengaged to hold the calf-supporting section 128 in this position. The calf-holding strap 138 is then placed around the patient's calf and fastened so that the patient's lower leg is securely held in the leg-support assembly 120. When the patient is comfortably in position, the wheel stops on the wheelchair W should be locked to prevent movement of the wheelchair during exercise. The adjustable length calf-supporting section 128 with the calf-holding strap 138 and calf-supporting arms 136 prevents the patient's legs from creeping inwardly or outwardly during exercise to prevent stress to the patient's knees.

After the patient is in position, a second person, such as a friend, family member or therapist, moves into position on the seat assembly 28 by sitting on the seat 37 with his feet on the pedals 100 of the first sprocket assembly 92. The therapist can grip the handgrips 64 mounted on the handlebar 62 in similar manner to that of riding a conventional bicycle. The height of the seat 37 is adjustable by loosening the height adjustment device 40 to telescope the shaft 36 into and out of the first post 32. When the desired seat height is achieved, the height adjustment device 40 is then retightened to hold the seat 37 in this position. The therapist then begins applying pedal power to the pedals 100 of the first sprocket assembly 92. This pedaling causes rotation of the second sprocket assembly 94 and, hence, the leg-support assemblies 120 in which the legs of the patient are held. In this manner, the patient's legs are moved by the therapist in a pedaling motion to provide beneficial, therapeutic treatment to the patient's legs. The speed of rotation of the leg-support assemblies 120 is directly controlled by the pedaling speed of the therapist. Should the therapist detect any problem with the patient, the therapist can immediately stop the movement of the patient's legs by ceasing pedaling.

In addition to exercising the patient's legs, the patient's upper torso and arms can be exercised by using the upper torso exercise device 68. The patient simply removes the handles 78 from the holding elements 72 and alternately pulls the handles 78 to obtain a complete upper body workout. The resistance of the upper torso exercise device 68 is adjustable by using the tension adjustment handle 80.

With the exercise device 10 of the invention, the therapist and patient are in constant visual and voice contact and the therapist has immediate and direct control over the speed of rotation of the leg-support assemblies 120 holding the patient's legs. The therapist can thus constantly monitor the patient during the exercise routine. The personal participation of the therapist with the patient transforms a mundane medical treatment procedure into a fun experience for both parties. Additionally, the therapist enjoys the benefits of exercising along with the patient.

When the exercise treatment is completed, the therapist stops pedaling, which simultaneously stops the movement of the leg-support assemblies 120 attached to the patient's legs. The foot-holding straps 124 and calf-holding straps 138 are loosened to release the patient's legs. The wheelchair W and patient may then be wheeled away from the exercise device 10. The support plates 20, 20' can be folded around the hinges 22, 22' to allow easier storage of the exercise device 10. Operation of the exercise device 142 is the same as that described above for the exercise device 10.

While in the preferred method of operation discussed above the patient is seated in a wheelchair W, it should be readily apparent that the patient need not be seated in a wheelchair to use the exercise devices 10 and 142 of the invention. The patient can be seated in a conventional chair in front of the exercise devices. Alternatively, to utilize the upper torso exercise device 68 above, the patient could sit or stand in front of the exercise device and use the upper torso exercise device 68 without having to use the leg-support assemblies 120.

It will be readily appreciated by those skilled in the art that modifications may be made to the invention without departing from the concepts disclosed in the foregoing description. Such modifications are to be considered as included within the following claims unless the claims, by their language, expressly state otherwise. Accordingly, the particular embodiments described in detail herein are illustrative only and are not limiting to the scope of the invention which is to be given the full breadth of the appended claims and any and all equivalents thereof.

We claim:

1. An exercise device, comprising:

a base; and a crank assembly carried on the base, the crank assembly including a first sprocket assembly having a pair of foot pedals and a second sprocket assembly having at least one leg-support assembly adapted to support a leg of a mobility-impaired person, wherein the first sprocket assembly is connected to the second sprocket assembly such that rotation of the first sprocket assembly causes rotation of the second sprocket assembly whereby the leg of the mobility-impaired person attached to the at least one leg-support assembly is exercised, wherein the at least one leg-support assembly includes:

a foot plate;

a calf-supporting section connected to the foot plate, the calf-supporting section having a first segment and a second segment with the second segment movable with respect to the first segment; and a locking device carried on the calf-supporting section and configured to maintain the second segment at a selected position with respect to the first segment such that the length of the calf-supporting section is adjustable.

2. The exercise device as claimed in claim 1, wherein the device further includes a seat assembly mounted on the base.

3. The exercise device as claimed in claim 1, including a post having a first end and a second end, with the first end of the post attached to the base.

4. The exercise device as claimed in claim 1, wherein the base includes at least one support plate hingeably connected to the base.

5. The exercise device as claimed in claim 1, including a cross member carried on the base, wherein the crank assembly is mounted on the cross member.

6. The exercise device as claimed in claim 2, wherein the seat assembly includes a first post connected to the base, a shaft slidably carried in the first post and a seat carried on the shaft.

7. The exercise device as claimed in claim 3, including a handlebar connected to the second end of the post.

8. The exercise device as claimed in claim 3, including a shelf member having a first end and a second end, the shelf member connected to the second end of the post.

9. The exercise device as claimed in claim 3, including an upper torso exercise device mounted on the second end of the post.

10. The exercise device as claimed in claim 5, wherein the first sprocket assembly is connected to the second sprocket assembly by a chain and the device further includes a tensioning device mounted on the cross member to maintain a selected tension on the chain.

11. The exercise device as claimed in claim 9, wherein the second sprocket assembly includes a leg support assembly having a foot plate and which includes at least one foot-holding strap and a calf-supporting section which includes at least one calf-holding strap.

12. The exercise device as claimed in claim 6, further including a height adjustment device attached to the seat assembly and configured to maintain the seat at a selected distance from the base.

13. The exercise device as claimed in claim 8, including a pair of holding elements extending from the shelf element adjacent the second end of the shelf element.

14. The exercise device as claimed in claim 11, including a pair of curved calf-supporting arms mounted on the calf-supporting section.

15. A tandem exercise device for operation by a first person to exercise the legs of a second mobility-impaired person, the device comprising:

a base;

a seat assembly mounted on the base, the seat assembly having a first post;

a second post having a first end mounted on the base and a second end, with the second post spaced from the first post;

a cross member connected to the first and second posts; and a crank assembly mounted on the cross member, the crank assembly including a first rotatable sprocket assembly having a first sprocket with a pair of foot pedals connected to the first sprocket and a second rotatable sprocket assembly having a second sprocket with at least one leg-support assembly carried on the second sprocket and configured to support a leg of the second person, wherein the first sprocket is connected to the second sprocket such that rotation of the first sprocket by the first person causes rotation of the second sprocket whereby the leg of the second person attached to the at least one leg-support assembly is exercised, and wherein the at least one leg-support assembly includes:

a foot plate;

a calf-supporting section connected to the foot plate, the calf-supporting section having a first segment and a second segment with the second segment movable with respect to the first segment; and a locking device carried on the calf-supporting section and configured to maintain the second segment at a selected position with respect to the first segment such that the length of the calf-supporting section is adjustable.

16. The exercise device as claimed in claim 15, including a handlebar carried on the second end of the second post.

17. The exercise device as claimed in claim 15, including an upper torso exercise device carried on the second end of the second post.

18. The exercise device as claimed in claim 16, including a shelf member connected to the second end of the second post with the shelf member having a first end and a second end and with the handlebar attached adjacent the first end of the shelf member.

19. A tandem exercise device for operation by a first person to exercise the legs of a second, mobility-impaired person, the device comprising a base having an upper surface and at least one support plate hingeably connected to the base;

a seat assembly carried on the base, the seat assembly including a first post attached to the upper surface of the base, a shaft having a first end and a second end and slidably carried in the first post, a seat attached to the second end of the shaft and a height adjustment device configured to maintain the seat at a selected distance from the base;

a second post carried on the base and spaced from the first post, the second post having a first end connected to the upper surface of the base and a second end;

a shelf member attached to the second end of the second post, the shelf member having a first end and a second end;

a handlebar located adjacent the first end of the shelf member;

an upper torso exercise device carried on the shelf member, the upper torso exercise device having a tension spool mounted on the shelf member, a rope element carried on the tension spool and a pair of handles located at the ends of the rope element;

a cross member attached to at least one of the first post and the second post;

a crank assembly mounted on the cross member, the crank assembly including a first sprocket assembly and a second sprocket assembly spaced from the first sprocket assembly, with the first sprocket assembly including a rotatable first sprocket having a pair of first crank arms extending from the first sprocket and a pedal rotatably carried on the outer end of each first crank arm and with the second sprocket assembly including a rotatable second sprocket having a pair of second crank arms extending from the second sprocket;

a chain configured to engage the first and second sprockets such that rotation of one of the first and second sprockets causes rotation of the other of the first and second sprockets; and a leg-support assembly carried on an outer end of each of the second crank arms, each leg-support assembly including:

a foot plate;

at least one foot-holding strap carried on the foot plate;

a calf-supporting section, the calf-supporting section including a first segment and a second segment, with the second segment adjustable with respect to the first segment;

a locking device carried on the calf-supporting section and configured to maintain the second segment at a selected position on the first segment to adjust the length of the calf-supporting section;

at least one calf-holding strap carried on the calf-supporting section; and a pair of calf-supporting arms located on the calf-supporting section.

* * * * *

UNITED STATES PATENT AND TRADEMARK OFFICE

CERTIFICATE OF CORRECTION

PATENT NO. : 5,951,442

DATED : September 14, 1999

INVENTOR(S) : Richard D. Adams et al.

It is certified that error appears in the above-identified patent and that said Letters Patent is hereby corrected as shown below:

Column 1 Line 43 "discloses a having" should read --discloses a mechanical device having--.

Column 7 Line 9 Claim 11 "claimed in claim 9" should read --claimed in claim 1--.

Signed and Sealed this

Twenty-fifth Day of April, 2000

*Attest:*

Q. TODD DICKINSON

*Attesting Officer*

*Director of Patents and Trademarks*